US006585261B2

(12) United States Patent
Miller et al.

(10) Patent No.: US 6,585,261 B2
(45) Date of Patent: Jul. 1, 2003

(54) TRACK BOTTOM APPARATUS FOR USE IN A DOCUMENT PROCESSING SYSTEM

(75) Inventors: Jeffrey H. Miller, Waterloo (CA); Fredrik L. N. Kallin, Waterloo (CA)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/952,698

(22) Filed: Sep. 14, 2001

(65) Prior Publication Data

US 2003/0052443 A1 Mar. 20, 2003

(51) Int. Cl.[7] ..... B65H 5/06

(52) U.S. Cl. ..... 271/264; 198/841; 198/867.7; 198/837

(58) Field of Search ..... 198/841, 861.1, 198/837, 735.3; 72/149; 384/41, 42; 193/8, 2 R, 38

(56) References Cited

U.S. PATENT DOCUMENTS 3,106,117 A * 10/1963 Duquesnel ..... 82/149
4,282,968 A * 8/1981 Temme ..... 198/735.2

* cited by examiner

*Primary Examiner*—Donald P. Walsh
*Assistant Examiner*—Kaitlin Joerger
(74) *Attorney, Agent, or Firm*—Michael Chan

(57) ABSTRACT

A track bottom piece is provided for use in a document processing system having a baseplate. A document track is defined in a surface of the track bottom piece. Document items can move along the document track from an upstream end to a downstream end. An angled surface is defined along an edge of the track bottom piece. The angled surface receives a releasable mechanism to secure the track bottom piece relative to the baseplate. When the releasable mechanism is released, the track bottom piece is allowed to move relative to the baseplate.

8 Claims, 3 Drawing Sheets

FIG. 2
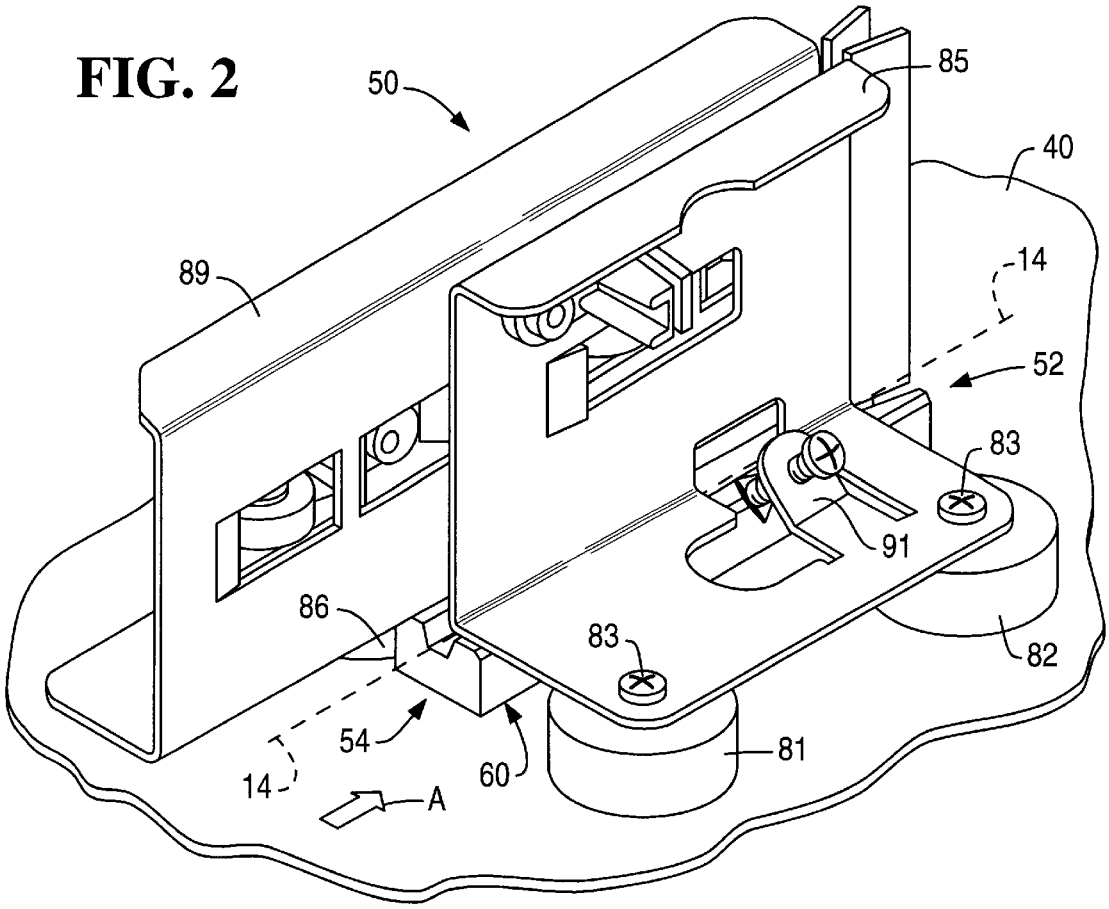
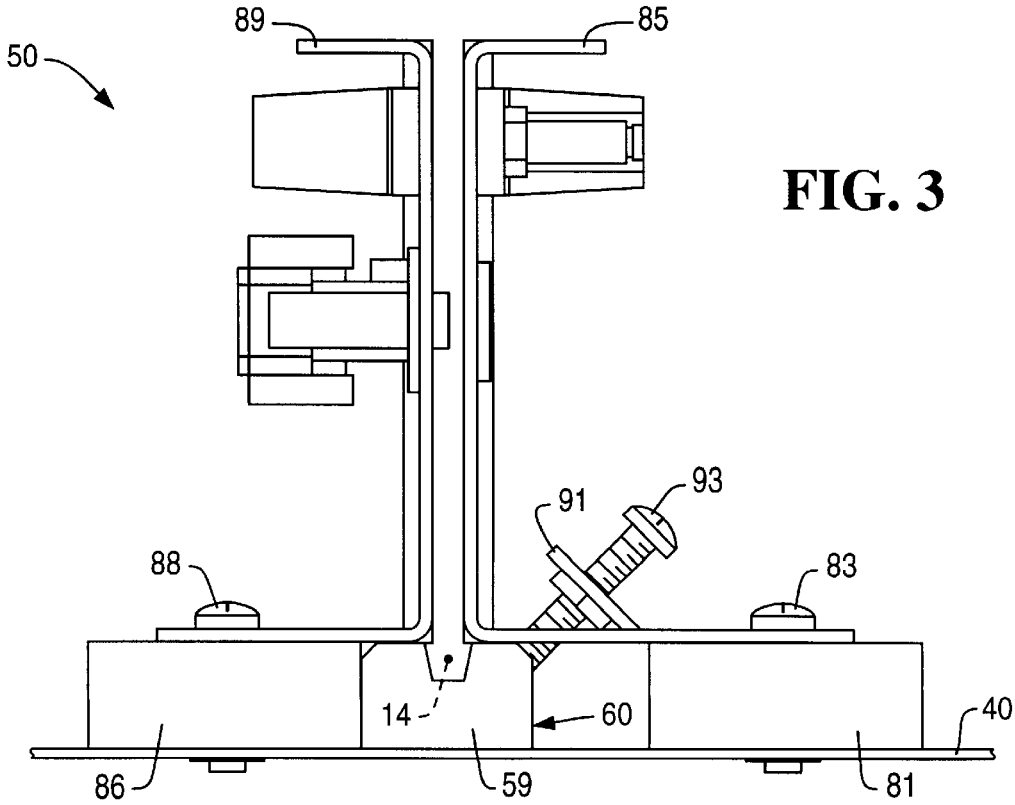
FIG. 3

TRACK BOTTOM APPARATUS FOR USE IN A DOCUMENT PROCESSING SYSTEM

BACKGROUND OF THE INVENTION

The present invention relates to document processing systems, and is particularly directed to a track bottom apparatus for use in a document processing system, such as an image-based check processing system.

A typical image-based check processing system includes a check processing transport which has a document track and a number of different hardware devices positioned along the document track for performing specific document processing operations on document items including checks moving downstream along the document track. The check processing system also includes a transport processor which executes a transport application program which is stored in memory to control operation of the hardware devices positioned along the document track and thereby to control operation of the check processing transport.

More specifically, the check processing transport includes a hopper into which a stack of document items including checks are placed. A document feeder adjacent the hopper selectively feeds or drives each document item from the stack of document items in the hopper to transport the document item from the upstream end to the downstream end along the document track to sorting pockets located at the end of the document track. The pockets receive document items which have been sorted in accordance with the transport application program.

During operational life of the check processing transport, numerous document items in a vertical orientation move down the document track at high speeds over long periods of time. Track bottom pieces are usually aligned with each other to define the document track along which the vertically-oriented document items move. Each track bottom piece has a metal surface against which the bottom edge of each vertically-oriented document item engages as the document item moves downstream along the document track. Due to frictional wear between the metal surface of the track bottom piece and the bottom edge of the vertically-oriented document item moving downstream along the document track, the track bottom piece needs to be replaced several times during operational life of the check processing transport.

Presently, when a worn track bottom piece needs to be replaced, a number of hardware parts associated with the check processing transport needs to be disassembled and removed in order to gain access to the worn track bottom piece. The worn track bottom piece is removed and replace with a new track bottom piece. The amount of work required to first disassemble and remove the hardware parts to gain access to the worn track bottom piece and then to replace and reassemble the hardware parts after the worn track bottom piece is removed and replaced with the new track bottom piece is usually quite extensive. It would be desirable to minimize the amount of work required to remove the worn track bottom piece and to replace it with the new track bottom piece.

SUMMARY OF THE INVENTION

In accordance with one aspect of the present invention, a track bottom apparatus is provided for use in a document processing system having a baseplate and a number of hardware parts which are secured in respective predetermined positions relative to the baseplate. The apparatus comprises a track bottom piece including means defining a document track along which document items can move from an upstream end to a downstream end. Releasable means is provided for (i) releasably securing the track bottom piece in a predetermined position relative to the baseplate, and (ii) when released, releases the track bottom piece to allow the track bottom piece to be removed and replaced with another track bottom piece while the hardware parts are maintained secured in their respective predetermined positions relative to the baseplate. The releasable means may include a screw which releasably secures the track bottom piece in its predetermined position relative to the baseplate when the screw presses against at least a portion of the track bottom piece.

In accordance with another aspect of the present invention, a track bottom apparatus is provided for use in a document processing system having a baseplate and a number of hardware parts which are secured in respective predetermined positions relative to the baseplate. The apparatus comprises a track bottom piece including means defining a document track along which document items can move from an upstream end to a downstream end. Releasable means is provided for (i) releasably securing the track bottom piece in a predetermined position relative to the baseplate, and (ii) when released, releases the track bottom piece to allow the track bottom piece to be removed and replaced with another track bottom piece without having to unsecure any of the hardware parts from their predetermined positions relative to the baseplate. The releasable means may include a screw which releasably secures the track bottom piece in its predetermined position relative to the baseplate when the screw presses against at least a portion of the track bottom piece.

In accordance with still another aspect of the present invention, a track bottom apparatus comprises a track bottom piece including means defining a document track along which document items can move from an upstream end to a downstream end. Releasable means is provided for (i) releasably securing the track bottom piece in a predetermined position along a first direction which is substantially parallel to the document track and along a second direction which is transverse to the first direction, and (ii) when released, releases the track bottom piece for movement along the first and second directions to allow the track bottom piece to be removed and replaced with another track bottom piece. The releasable means may include means for securing the track bottom piece in position along a third direction which is transverse to the first direction and which is transverse to the second direction. The releasable means may include a screw which releasably secures the track bottom piece in its predetermined position relative to the baseplate when the screw presses against at least a portion of the track bottom piece.

In accordance with yet another aspect of the present invention, a track bottom piece is provided for use in a document processing system having a baseplate. The piece comprises means defining a surface having an edge, means defining a document track in the surface and along which document items can move from an upstream end to a downstream end, and means defining an angled surface along the edge for receiving a releasable mechanism to secure the track bottom piece relative to the baseplate and, when released, allowing the track bottom piece to be moved relative to the baseplate.

In accordance with still another aspect of the present invention, a check processing apparatus comprises a number of check guide standoffs, a track bottom piece including means defining a document track along which document items can move from an upstream end to a downstream end, and releasable means for (i) releasably securing the track bottom piece in a predetermined position relative to the check guide standoffs, and (ii) when released, releases the track bottom piece to allow the track bottom piece to be removed and replaced with another track bottom piece. The releasable means may include a screw which releasably secures the track bottom piece in its predetermined position relative to the check guide standoffs when the screw presses against at least a portion of the track bottom piece. The number of check guide standoffs may comprise a plurality of check guide standoffs.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein:

FIG. 2 is a perspective view of a track bottom apparatus used in the image-based check processing system of FIG. 1;

FIG. 3 is an elevational view looking in the direction of arrow A in FIG. 2.

DETAILS OF THE INVENTION

Figure 1:
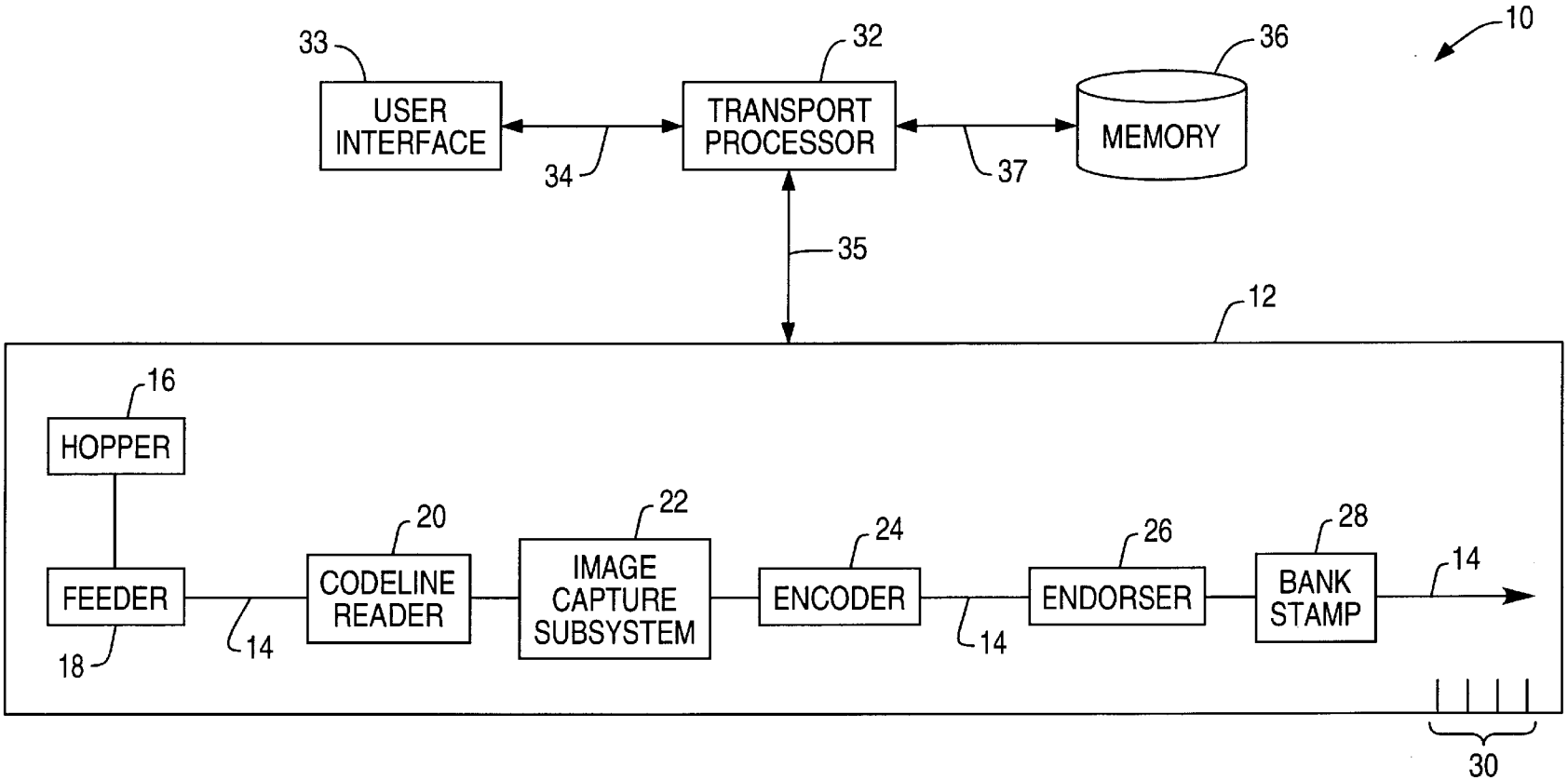
FIG. 1 is a schematic block representation of an image-based check processing system embodying the present invention.

The present invention is directed to a track bottom apparatus for use in a document processing system. The specific construction and use of the document processing system may vary. By way of example, a document processing system in the form of an image-based check processing system 10 is illustrated in FIG. 1. The check processing system 10 may be, for example, a sorting machine or a proof machine wherein financial document items such as checks are processed in a bank.

As shown in FIG. 1, the check processing system 10 includes a check processing transport 12 having a document track 14 along which financial document items, such as checks, can be transported from an upstream end to a downstream end. The transport 12 includes a number of different hardware devices lying along the document track 14 for performing specific document processing operations on document items moving along the document track. The transport 12 includes a hopper 16 into which a stack of financial document items including checks are placed. A document feeder 18 adjacent the hopper 16 selectively feeds or drives each document item from the stack of document items in the hopper to transport the document item from the upstream end to the downstream end along the document track 14 to sorting pockets 30 located at the end of the document track.

The check processing system 10 includes a codeline reader 20 such as a MICR reader located along the document track 14. The MICR reader 20 reads a MICR codeline from each check being processed in a known manner. Alternatively, the codeline reader may be an OCR reader instead of a MICR reader depending upon the particular application. The check processing system 10 further includes an image capture subsystem 22 located along the document track 14. The image capture subsystem 22 captures an image of each document item for a number of different purposes well known in the financial industry. More specifically, the image capture subsystem 22 includes an imaging camera (not shown) which is controlled to capture images of document items moving along the document track 14. An encoder 24 encodes missing fields on each check. An endorser 26 applies an endorsement in a known manner to each check. A bank stamp 28 stamps each check to identify the bank institution processing the check. The structure and operation of MICR readers, OCR readers, imaging cameras, encoders, endorsers, and bank stamps are well known and, therefore, will not be described.

The check processing system 10 further includes a transport processor 32 and a user interface 33 which communicates via signals on line 34 with the transport processor. The user interface 33 may include a keyboard, a mouse, and a display, all of which communicate via signals with the transport processor 32. The transport processor 32 controls operation of the transport 12 via signals on line 35. Suitable processors and memories are readily available in the marketplace. Their structure and operation are well known and, therefore, will not be described.

The check processing system 10 also includes a memory 36 which communicates via signals on line 37 with the transport processor 32. It is contemplated that the memory 36 could be a single memory unit or a plurality of different memory units. An executable transport application program is stored in the memory 36. The transport application program is associated with a particular type of document processing work. For example, one type of work is proof of deposit. Another type of work is remittance processing. Still another type of work may be sorting of document items. When the transport application program is executed, the hardware devices lying along the document track 14 are controlled to process document items moving downstream along the document track in accordance with the transport application program, as is known. The memory 36 also stores sequence numbers, MICR codelines, image data, encoder status, endorsement status, and bank stamp status associated with document items which have been processed in accordance with the transport application program.

Figure 4:
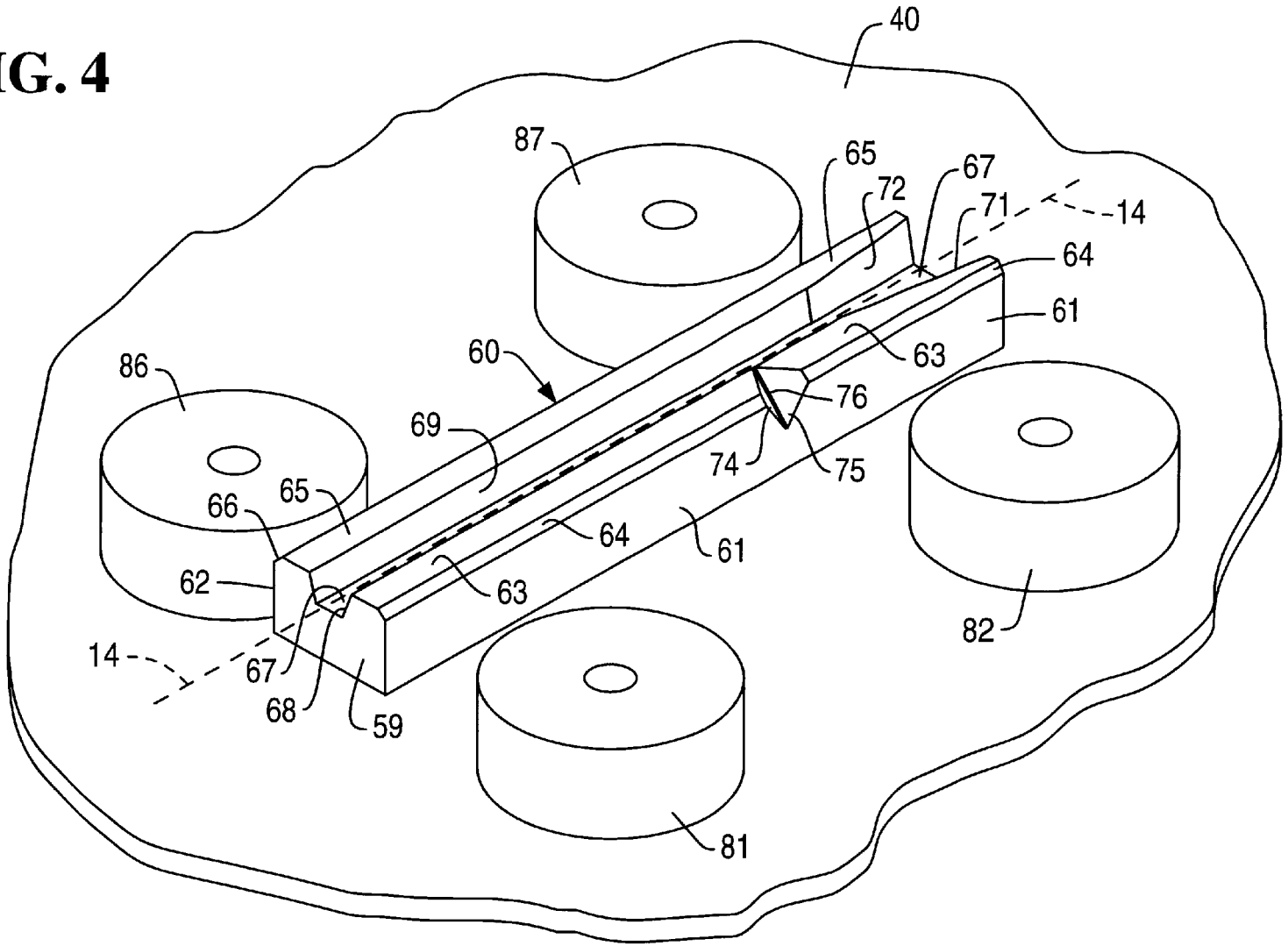
FIG. 4 is a perspective view similar to FIG. 2 and showing some parts removed.

Referring to FIGS. 2, 3, and 4, a track bottom apparatus 50 constructed in accordance with the present invention is embodied in the check processing system 10 of FIG. 1. The check processing system 10 includes a baseplate 40 on which the track bottom apparatus 50 is disposed. The track bottom apparatus 50 includes a track bottom piece 60 (as best shown in FIG. 4) which has an upstream end 52 and a downstream end 54. The document track 14 (shown in dashed lines) extends between the upstream end 52 and the downstream end 54.

The track bottom piece 60 includes a downstream end surface portion 59 which interconnects a first side surface portion 61 and a second side surface portion 62. The track bottom piece 60 further includes a first top surface portion 63 and a first angled surface portion 64 which interconnects the first side surface portion 61 and the first top surface portion 63. Similarly, the track bottom piece 60 includes a second top surface portion 65 and a second angled surface portion 66 which interconnects the second side surface portion 62 and the second top surface portion 65.

The track bottom piece 60 includes an inner bottom surface 67 and a first inner side surface portion 68 which interconnects the first top surface portion 63 and the inner bottom surface portion 67. Similarly, the track bottom piece 60 includes a second inner side surface portion 69 which interconnects the second top surface portion 65 and the inner bottom surface portion 67. The inner bottom surface portion 67, the first inner side surface portion 68, and the second inner side surface portion 69 form a portion of the document track 14.

At the upstream end 52 of the track bottom piece 60, a first tapered side surface portion 71 interconnects the first top surface portion 63 and the inner bottom surface portion 67. Similarly, a second tapered side surface portion 72 interconnects the second top surface portion 65 and the inner bottom surface portion 67. The inner bottom surface portion 67 and the first and second tapered side surface portions 71, 72 form a tapered portion of the track bottom piece 60 at the upstream end 52 thereof. The tapered portion of the track bottom piece 60 allows this track bottom piece to be abutted against the downstream end surface portion of another track bottom piece (not shown) which is disposed immediately upstream from the track bottom piece 60. It should be noted that the track bottom piece upstream from the track bottom piece 60 has the same construction as the track bottom piece 60. The tapered portion of the track bottom piece 60 eliminates, or at least reduces, the chance of a document item becoming jammed in the document track 14 when the leading edge of the document item moves from document track portion of the upstream track bottom piece (not shown) into the document track portion of the track bottom piece 60.

As best shown in FIG. 4, a pair of angled surfaces 74, 75 forms an angled notch 76 which is disposed in the first side surface portion 61, the first top surface portion 63, and the first angled surface portion 64. The notch 76 is formed for receiving the end of a threaded screw to secure the track bottom piece 60 to the baseplate 40, as will be described in detail herein A first pair of standoffs 81, 82 is disposed along the first side surface portion 61 of the track bottom piece 60. A pair of screws 83 secures a rear check guide 85 (FIGS. 2 and 3) on the first pair of standoffs 81, 82 to the baseplate 40. Similarly, a second pair of standoffs 86, 87, as best shown in FIG. 4, is disposed along the second side surface portion 62 of the track bottom piece 60. A pair of screws 88 secures a front check guide 89 (FIGS. 2 and 3) on the second pair of standoffs 86, 87 to the baseplate 40.

The rear check guide 85 has an angled tab portion 91 through which a threaded hole is formed. The angled tab portion 91 is positioned relative to the track bottom piece 60 such that the end of a screw 93 is received in the notch 76 and abuts the pair of angled surfaces 74, 75 of the track bottom piece 60 when the screw 93 is screwed into the threaded hole of the angled tab portion 91. When the screw 93 is tightened, the end of the screw 93 presses against the pair of angled surfaces 74, 75 such that the second side surface portion 62 of the track bottom piece 60 presses against the outer circumferential surfaces of the second pair of standoffs 86, 87 and the bottom of the track bottom piece 60 presses against the baseplate 40. This pressing action prevents the track bottom piece 60 from sliding relative to the baseplate 40 and thereby secures the track bottom piece 60 to the baseplate 40.

When the track bottom piece 60 is worn and needs to be replaced, a field-service operator unscrews the screw 93 at least enough to release the worn track bottom piece 60. The operator manipulates the worn track bottom piece 60 to move it around the first set of standoffs 81, 82 so that the worn track bottom piece 60 can be removed. After the worn track bottom piece 60 is removed, the operator manipulates a new track bottom piece (not shown) to move it around the first pair of standoffs 81, 82 until the new track bottom piece is in the position which was previously occupied by the worn track bottom piece 60. The operator then screws the screw 93 back into the threaded hole of the angled tab portion 91 until the end of the screw 93 is received in the notch and engages the pair of angled surfaces of the new track bottom piece. The new track bottom piece is pressed against the second pair of standoffs 86, 87 and the baseplate 40 in the same manner as previously described with respect to the now removed track bottom piece 60 to secure the new track bottom piece to the baseplate 40.

A number of advantages result by providing the track bottom apparatus 50 in accordance with the present invention. One advantage is that the track bottom piece 60 can be quickly and easily removed without having to remove any hardware parts associated with the check processing transport 12. This reduces the amount of time required for a field service operator to remove and replace the track bottom piece 60. Accordingly, costs are reduced. Another advantage is that there is less downtime during operational life of the check processing system since less time is needed to service the check processing system.

Still another advantage is that the document track 14 is more accurately located. The document track 14 is more accurately located because of the improved accuracy in locating the track bottom piece 60 on the baseplate 40. The improved accuracy in locating the track bottom piece 60 on the baseplate 40 is due to the precision of the outer circumferential surfaces of the second pair of standoffs 86, 87 against which the track bottom piece abuts.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. An apparatus comprising:

a baseplate;

means defining a document track along which document items can move from an upstream end to a downstream end;

at least one document processing device secured in a predetermined position relative to the baseplate and disposed along the document track for performing a document processing operation on documents moving from the upstream end of the document track to the downstream end of the document track;

a track bottom piece disposed on the baseplate and including surface means defining a groove which forms at least a portion of the document track; and releasable means for (i) releasably securing the track bottom piece in a predetermined position relative to the baseplate, and (ii) when released, releases the track bottom piece to allow the track bottom piece to be removed and replaced with another track bottom piece while the at least one document processing device is maintained secured in its predetermined position relative to the baseplate.

2. An apparatus according to claim 1, wherein the surface means defines a substantially U-shaped groove which forms at least a portion of the document track.

3. An apparatus according to claim 2, further comprising a first document guide member disposed on one side of the substantially U-shaped groove, and a second document guide member disposed on an opposite side of the substantially U-shaped groove.

4. An apparatus according to claim 3, further comprising at least one standoff member for supporting the first document guide member on the one side of the substantially U-shaped groove, and at least one standoff member for supporting the second document guide member disposed on the opposite side of the substantially U-shaped groove.

5. An apparatus according to claim 4 wherein the releasable means includes a screw which releasably secures the track bottom piece in its predetermined position relative to the baseplate when the screw presses against at least a portion of the track bottom piece.

6. An apparatus according to claim 5, further comprising a magnetic ink character recognition (MICR) codeline reader disposed along the document track and for reading codelines of checks moving from the upstream end of the document track to the downstream end of the document track.

7. An apparatus according to claim 1, wherein the releasable means includes a screw which releasably secures the track bottom piece in its predetermined position relative to the baseplate when the screw presses against at least a portion of the track bottom piece.

8. An apparatus according to claim 1, further comprising a magnetic ink character recognition (MICR) codeline reader disposed along the document track and for reading codelines of checks moving from the upstream end of the document track to the downstream end of the document track.

* * * * *